US010537183B2

(12) United States Patent
Nault et al.

(10) Patent No.: US 10,537,183 B2
(45) Date of Patent: Jan. 21, 2020

(54) BED TO A SOFA CONVERSION FRAME WITH MOVABLE BACK

(71) Applicant: BED TO A SOFA CONVERSION COMPANY, LLC, Chantilly, VA (US)

(72) Inventors: Brian Nault, Chantilly, VA (US); Brandon Kershner, Hayward, CA (US)

(73) Assignee: BED TO A SOFA CONVERSION COMPANY, LLC, Chantilly, VA (US)

( * ) Notice: Subject to any disclaimer, the term of this patent is extended or adjusted under 35 U.S.C. 154(b) by 560 days.

(21) Appl. No.: 14/996,609

(22) Filed: Jan. 15, 2016

(65) Prior Publication Data

US 2016/0206109 A1 Jul. 21, 2016

Related U.S. Application Data

(60) Provisional application No. 62/104,674, filed on Jan. 16, 2015.

(51) Int. Cl.
*A47C 17/16* (2006.01)
*A47C 17/18* (2006.01)

(52) U.S. Cl.
CPC ..... *A47C 17/162* (2013.01); *A47C 17/18* (2013.01)

(58) Field of Classification Search
CPC ..... A47C 17/04; A47C 17/16; A47C 17/161; A47C 17/18; A47C 17/2076; A47C 17/52; A47C 17/58; A47C 19/021; A47C 19/04
See application file for complete search history.

(56) References Cited

U.S. PATENT DOCUMENTS 375,817 A * 1/1888 Hoey ..... A47C 17/16 5/38
624,008 A * 5/1899 Genge ..... A47C 17/86 5/38
2,723,401 A * 11/1955 Brede-Horst ..... A47C 17/16 5/37.1
2,808,595 A 10/1957 McLean
2,866,982 A * 1/1959 Purves, Jr. ..... A47C 17/1655 5/45

(Continued)

FOREIGN PATENT DOCUMENTS

CH 538835 A * 7/1973 ..... A47C 1/026
DE 2757346 A1 * 6/1979 ..... A47C 17/16

(Continued)

OTHER PUBLICATIONS

International Search Report and Written Opinion dated Mar. 21, 2016 in PCT/US16/13582 (9 pages).

*Primary Examiner* — Nicholas F Polito
(74) *Attorney, Agent, or Firm* — Buchanan Ingersoll & Rooney P.C.

(57) ABSTRACT

A bed to a sofa conversion frame, without a seating area, a space reserved for the traditional bed, which is a conventional manufactured mattress, or ii) a conventional manufactured mattress and a box spring, or iii) a conventional manufactured mattress and a two rail frame, optionally with a box spring. The bed to a sofa conversion frame includes a backrest, a footer (optional) and a pair of armrests configured to be connected as a solid state and or assembled together to form a sofa frame around a traditional bed, wherein the backrest is movable from a sofa position to a bed position, in order to convert the frame from a sofa configuration to a bed configuration.

11 Claims, 20 Drawing Sheets

(56) References Cited

U.S. PATENT DOCUMENTS

| | | | | | |
|---|---|---|---|---|---|
| 2,880,426 | A * | 4/1959 | Goldstein | ..... | A47C 17/16<br>5/37.1 |
| 3,327,328 | A * | 6/1967 | Slivoski | ..... | A47C 19/04<br>5/181 |
| 4,321,717 | A | 3/1982 | Serra | | |
| 5,517,706 | A | 5/1996 | Kashima | | |
| 7,648,197 | B1 * | 1/2010 | Delmestri | ..... | A47C 17/16<br>297/63 |
| 8,332,973 | B2 | 12/2012 | Davis | | |
| 2003/0014814 | A1 | 1/2003 | Brooks | | |
| 2003/0084507 | A1 | 5/2003 | Timoshenko | | |

FOREIGN PATENT DOCUMENTS

| | | | | | |
|---|---|---|---|---|---|
| DE | 3 621 662 | A | 1/1988 | | |
| DE | 9416801 | U1 * | 12/1994 | ..... | A47C 17/16 |
| DE | 20 2008 013 826 | U1 | 3/2009 | | |
| GB | 700288 | A * | 11/1953 | ..... | A47C 17/16 |
| GB | 945931 | A * | 1/1964 | ..... | A47C 17/16 |
| GB | 2 006 616 | A | 5/1979 | | |

* cited by examiner

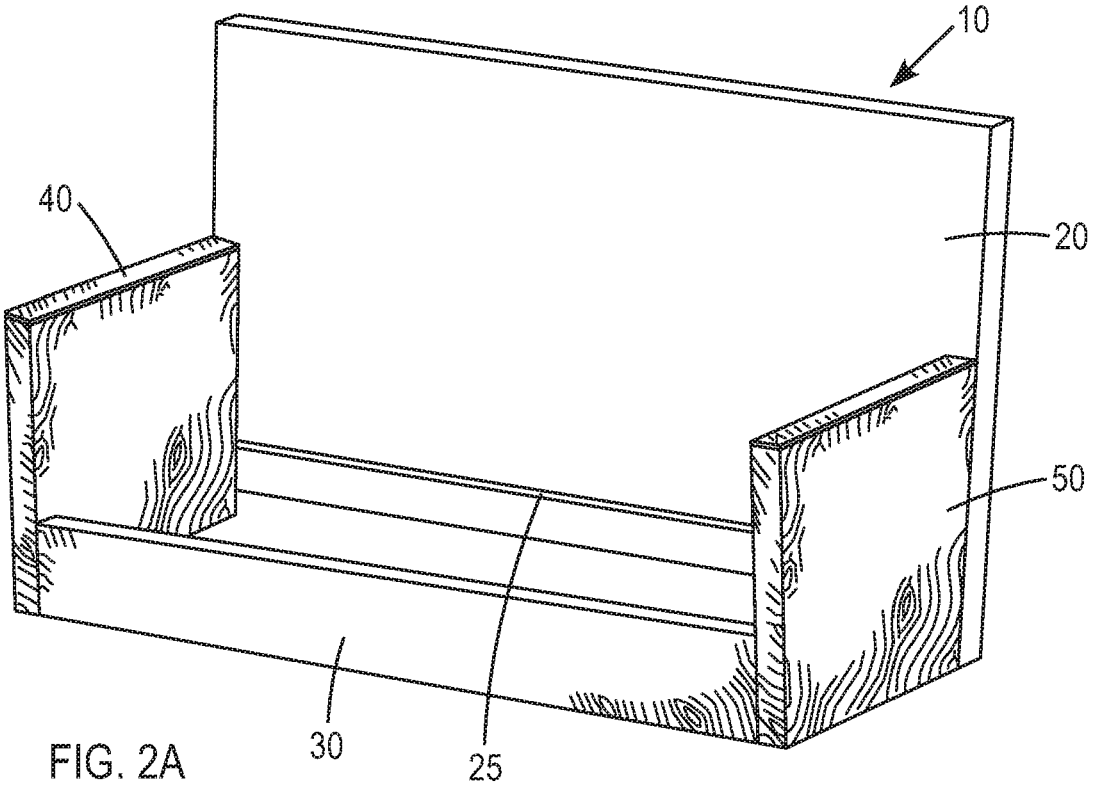
FIG. 2A
FIG. 2B FIG. 2C FIG. 2D FIG. 2E FIG. 2F
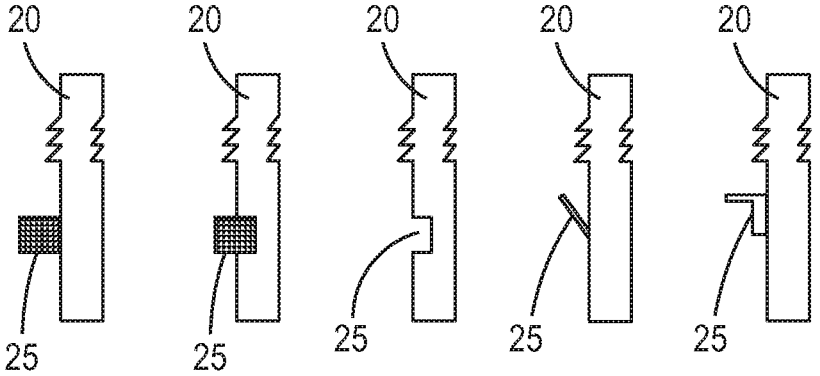
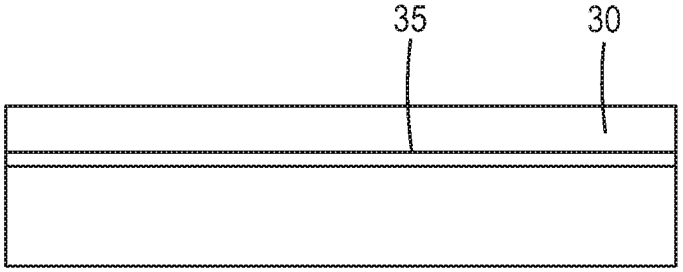
FIG. 2G

BED TO A SOFA CONVERSION FRAME WITH MOVABLE BACK

CROSS REFERENCE TO RELATED APPLICATIONS

The present application claims the benefit of U.S. Provisional Application No. 62/104,674, filed on Jan. 16, 2015. The entire contents of U.S. Provisional Application No. 62/104,674 are hereby incorporated by reference in their entirety.

TECHNICAL FIELD

The present disclosure relates to furniture and furniture accessories, and for example, to a sofa conversion frame for converting a bed into a sofa.

DESCRIPTION OF THE RELATED ART

Traditional beds of various different configurations use mattresses that do not fold and provide a comfortable environment for sleeping. The "traditional bed" refers to a bed comprising a conventional manufactured mattress that may or may not be placed together with a box spring and a standard two rail bed frame with or without a headboard and footer attached. However, the size of the traditional bed tends to occupy much of the available space in a room, for example a bedroom, hotel room, or studio apartment, leaving little room for other furniture such as a sofa. Several different solutions have been proposed to minimize the required space for a bed or to increase the functional aspects thereof.

A sofa, which is also referred to as a couch or settee or divan, is a piece of furniture for seating two or more persons in the form of a seating area with a back and armrests for two or more people, that maybe partly or wholly upholstered, and often fitted with springs and tailored cushions. A sofa is used primarily for seating and is normally used in living spaces such as, but not limited to, homes.

One solution involves a conventional sofa bed, which is also referred to as a sleeper sofa. This typically comprises a sofa that converts to a bed using a foldable internal frame and an unconventional foldable mattress that is stored below the cushioned seat of the sofa. It is generally recognized that when configured as a sofa it is a piece of furniture for seating two or more persons in the general form of a bench, with armrests, that may or may not be cushioned and/or upholstered. The internal frame and mattress contained in the sofa can be unfolded and configured to form a bed. The sofa bed is a space saving piece of furniture, but due to additional hardware and mattress, it is very heavy and unwieldy to move.

Another solution resides in futons. A futon is typically a foldable frame having an unconventional foldable mattress. The frame and mattress can be folded into a "sofa configuration" or unfolded to a "bed configuration". This is another sofa/bed combination maximizing living space. However, futons can be daunting to assemble, especially for the foldable frame where the rollers or sliders have to be installed in corresponding grooves.

Due to the above, the present applicant has determined that it would be a benefit in the art of furniture and furniture accessories to provide a space saving and dual function system, establishing a new product category with minimal assembly hassles and/or placement thereof referred to as "the bed to a sofa conversion frame" that converts a traditional bed comprising i) a conventional manufactured mattress, or ii) a conventional manufactured mattress and a box spring, or iii) a conventional manufactured mattress and a two rail frame, optionally with a box spring, into a sofa. A conventional manufactured mattress is defined as a mattress manufactured for traditional beds, such as but not limited to twin size, full size, queen size, king size, and other bed sizes manufactured for beds and is not configured to be folded when converted into the sofa.

Additionally, the usage of either a sofa bed or a futon requires the user to purchase and install either article of furniture. Most consumers already have a bed and the present applicant has determined that it would be desirable to provide multiple functionality for the traditional bed, comprising i) a conventional manufactured mattress, or ii) a conventional manufactured mattress and a box spring, or iii) a conventional manufactured mattress and a two rail frame, optionally with a box spring, allowing it to be used for additional furniture purposes without having to purchase or otherwise acquire and install additional pieces of furniture.

An improvement to the known embodiments, described above, is a frame that can easily convert a stand-alone traditional bed into a sofa (bed to a sofa conversion frame). This frame may have a benefit by creating a dual purpose for a traditional bed comprising i) a conventional manufactured mattress, or ii) a conventional manufactured mattress and a box spring, or iii) a conventional manufactured mattress and a two rail frame, optionally with a box spring, as described in U.S. Pat. No. 8,332,973.

To conserve space, some sofas double as beds in the form of sofa-beds, daybeds, futons, or the bed to a sofa conversion frame, which enables a bed to double as a sofa. The assembly of their frames can be made out of wood, metal, composite materials (e.g., resin), or a combination thereof. The assembly connections are completed through various means of nuts, bolts, joint connectors, glues, or a combination thereof.

SUMMARY

An exemplary embodiment of a "bed to a sofa conversion frame" is a separate frame that, when combined with a traditional bed comprising i) a conventional manufactured mattress, or ii) a conventional manufactured mattress and a box spring, or iii) a conventional manufactured mattress and a two rail frame, optionally with a box spring, will allow the traditional bed to function as a sofa. An exemplary embodiment of a frame includes a backrest, a footer (optional) and a pair of armrests configured as a solid state and or to be assembled together to form a sofa frame around a traditional bed. The separate frame does not include a standard seating area, as that function is performed by the traditional bed, after conversion. The open seating area is filled with the traditional bed, which will serve as the support for seating. The bed, when put in place to fill the openning, may or may not be covered with additional cushions or a form of fabric cover, often referred to as a slip cover.

An exemplary embodiment of a "bed to a sofa conversion frame" is a stand-alone frame, the frame being configured to convert a bed comprising a conventional manufactured mattress into a sofa, the frame including a backrest having backrest connectors at opposite ends thereof, a footer having footer connectors at opposite ends thereof, a pair of armrests forming a base, each armrest having a rear armrest connector configured to connect to a backrest connector at one end of the backrest and each armrest having a front armrest connector configured to connect to a footer connector at one end of the footer, and a space defined by the backrest, footer, and armrests, the space configured to be filled by the conventional manufactured mattress, wherein the backrest, footer and armrests, as a unitary piece or when connected together to form an assembled frame, form a frame configured for surrounding the bed to convert the bed into a sofa such that at least a portion of an upper surface area of the bed forms a seating area of the sofa, wherein the frame is a stand-alone frame separate from the bed, and wherein the backrest is movable from a sofa position to a bed position, in order to convert the frame from a sofa configuration to a bed configuration.

In an embodiment, the backrest may move from a sofa position to a bed position by rotation. The backrest may be attached to a position on the armrests (sides) of the frame and pivot from the sofa position to the bed position. The backrest may be attached to a rail or other attachment means on the armrests (sides) of the frame and slide from the sofa position to the bed position.

In an embodiment, the backrest may comprise a horizontally-extending backrest ridge configured to hold, directly or indirectly, a mattress. Further, in an embodiment, the footer may include a horizontally-extending footer ridge configured to hold, directly or indirectly, a conventional manufactured mattress or a conventional manufactured mattress and a box spring. In an embodiment, the armrests may include a horizontally-extending armrest ridge configured to hold, directly or indirectly, a conventional manufactured mattress or a conventional manufactured mattress and a box spring. In an embodiment, the backrest ridge has a support surface and the footer has a top surface, the backrest ridge support surface may be at the same height as the footer top surface. In an embodiment, the backrest ridge, the armrest ridges and/or the footer ridges may be formed as a structure protruding from the backrest, the arm rests or the footer, respectively. In an embodiment, the backrest ridge, the arm rest ridges and/or the footer ridges may be formed as a groove in the backrest, the arm rests and/or the footer, respectively.

In an embodiment, the frame allows a traditional bed comprising i) a conventional manufactured mattress, or ii) a conventional manufactured mattress and a box spring, or iii) a conventional manufactured mattress and a two rail frame, optionally with a box spring, to be used as both a bed and a sofa, without folding of the mattress.

In an embodiment, the pair of armrests forms a base for connecting the backrest and the footer via connectors, for example, corresponding mounting hardware and mounting slots. Both the backrest and the footer may be, individually, one solid piece, individual pieces connected by connectors, for example, brackets. Both the backrest and the footer may be, individually, detachable and foldable to provide easy breakdown and storage. In an embodiment, the frame may be one unitary piece, or an assembled frame that is not intended to be readily disassembled. For example, an assembled frame that is not intended to be readily disassembled may include a frame where disassembly results in permanent damage to connectors, to the frame or to a covering material. In an embodiment, the footer is not incorporated as a component of the frame. In an embodiment, the armrests can include an extension or an attached bracket to anchor the armrests and backrest to the bed.

These and other features and functions of embodiments of the present disclosure will become readily apparent upon further review of the following specification and drawings.

BRIEF DESCRIPTION OF THE DRAWINGS

FIG. 2A is an exemplary view of the bed to a sofa conversion frame according to an exemplary embodiment of the present disclosure.

FIGS. 2B-F are exemplary cross-sectional views of a backrest and a support ridge according to exemplary embodiments of the present disclosure.

FIG. 2G shows an exemplary view of the inner side of the footer according to an exemplary embodiment of the present disclosure, which can be similar to the cross-sectional views of a backrest and a support ridge shown in 2B-F.

Similar reference characters denote corresponding features consistently throughout the attached drawings.

DETAILED DESCRIPTION OF THE PREFERRED EMBODIMENTS

Figure 1:
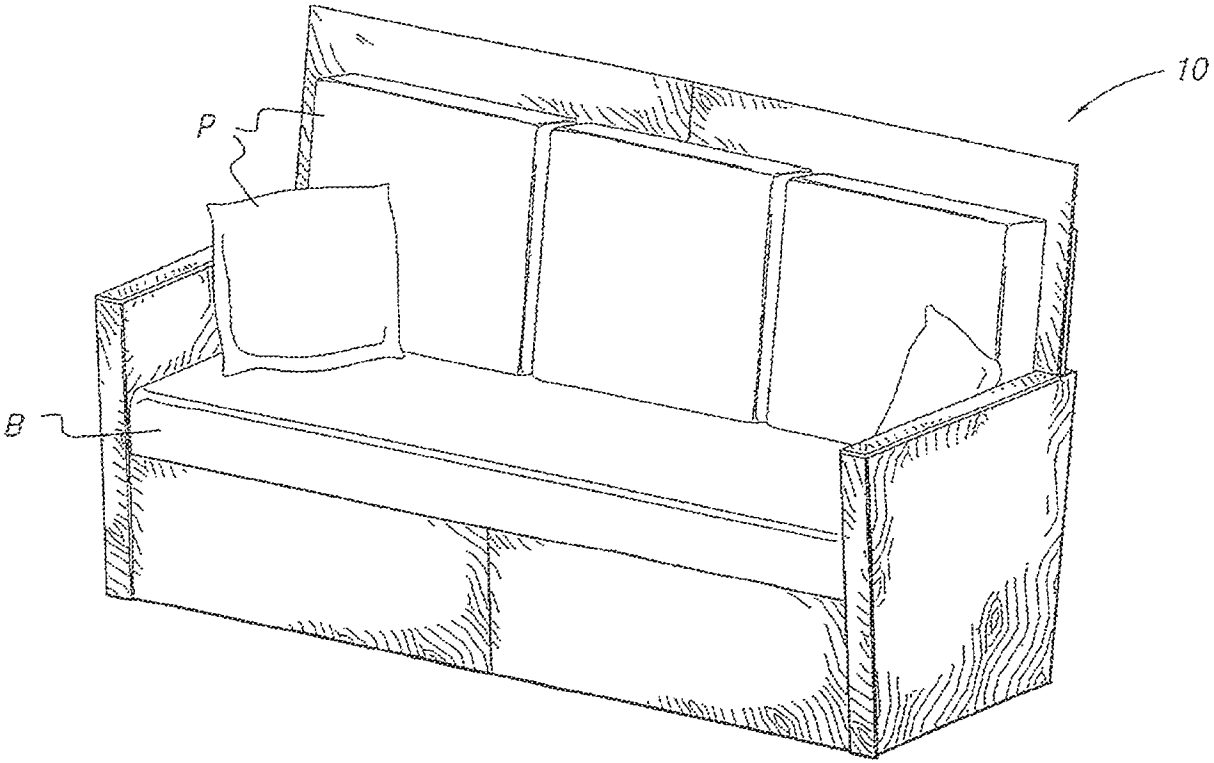
FIG. 1 is an environmental, perspective view of a bed to a sofa conversion frame according to an exemplary embodiment of the present disclosure, the frame being disposed about a traditional bed.

An exemplary embodiment of the present disclosure relates to a "bed to a sofa conversion frame," generally referred to in the drawings by reference number 10, for converting a bed into a sofa.

Shown in the exemplary embodiments of FIGS. 1 and 2 are exemplary views of the bed to a sofa conversion frame 10 includes a backrest 20, a footer 30, a left armrest 40, and a right armrest 50 that when connected together and or assembled to surround (also referred to as "wrap around") a bed B comprising i) a conventional manufactured mattress, or ii) a conventional manufactured mattress and a box spring, or iii) a conventional manufactured mattress and a two rail frame, optionally with a box spring, that when combined together form the sofa. A conventional manufactured mattress is defined as a mattress manufactured for beds, such as but not limited to twin size, full size, queen size, king size, and other bed sizes manufactured for beds. A conventional manufactured mattress is not configured to be folded during use or storage. In an embodiment, the exemplary bed to a sofa conversion frame shown in FIG. 1 is assembled, but the disclosure also contemplates variations where, for example, the frame is a solid one piece frame, referred to as "solid state." The bed B serves as the seating area for the sofa, and with placement of various pillows P, provides a comfortable seating and lounging environment for the user. In an embodiment, only a portion of the bed's upper surface area is used as a seating area for a sofa. In an embodiment, substantially all the upper surface of the bed may be used as a seating area for a sofa.

The example of the backrest 20 includes a backrest ridge 25. The backrest ridge 25 may be a horizontally-extending backrest ridge configured to hold, directly or indirectly, a conventional manufactured mattress. The backrest ridge may be formed as a structure protruding from the backrest. The backrest ridge may be formed as a groove in the backrest.

The footer may include a horizontally-extending footer ridge 35 configured to hold, directly or indirectly, a conventional manufactured mattress. The footer ridge 35 may be formed as a structure protruding from the footer 30. The footer ridge 35 may be formed as a groove in the footer 30.

The examples of the armrests 40, 50 may each include a horizontally-extending armrest ridge (not shown) configured to hold, directly or indirectly, a mattress. The armrest ridge may be formed as a structure protruding from the armrest(s) 40, 50. The armrest ridge may be formed as a groove in the armrest(s) 40, 50.

In an embodiment, the backrest ridge 25 has a support surface and the footer has a top surface, the backrest ridge support surface being at the same height as the footer top surface. In this manner, the backrest ridge 25 and the footer top surface can hold supports parallel to the ground.

The backrest ridge 25 may be permanently attached or detachably attached to the frame 10. The backrest ridge 25 may be configured to hold a support structure, such as wooden slats, that could support a mattress (and the weight of a person or persons using the mattress). The backrest ridge 25 allows the conversion frame 10 to hold and convert a conventional manufactured mattress into a sofa. The backrest ridge 25 may extend along the entire or substantially the entire (e.g., at least 80%) of the length of the backrest 20. The backrest ridge 25 may be in the form of two or three or more independent ridges horizontally extending alone the length of the backrest 20, with or without gaps there between. FIGS. 2B-F show exemplary cross-sectional views of a backrest 20 and a backrest ridge 25. All embodiments of the backrest ridge 25 may also be applicable to the footer ridge 35 and the armrest ridge(s). The footer 30 may include a footer ridge 35, as shown in FIG. 2G.

In an embodiment, the backrest 20 may vertically extend to the ground, to the backrest ridge 25, or to a level between the ground and backrest ridge 25.

To show the flexibility of various embodiments of the disclosure, an example of the bed to a sofa conversion frame 10 is that it can be configured for easy assembly, disassembly and storage. As shown in the exemplary embodiments of FIGS. 3A and 3B, both the backrest 20 and the footer 30 may be foldable along respective folds 22, 32 via hinges 23, 33. As a result, all the disassembled pieces including the armrests 40, 50 occupy a relatively small amount of space for convenient storage and/or transport. Both the backrest 20 and the footer 30 may include additional folds, or they may include separate panels that can be assembled to form the backrest and the footer. It is also possible to have both the backrest 20 and the footer 30 be unfoldable and/or each one of one piece.

Figure 3A:
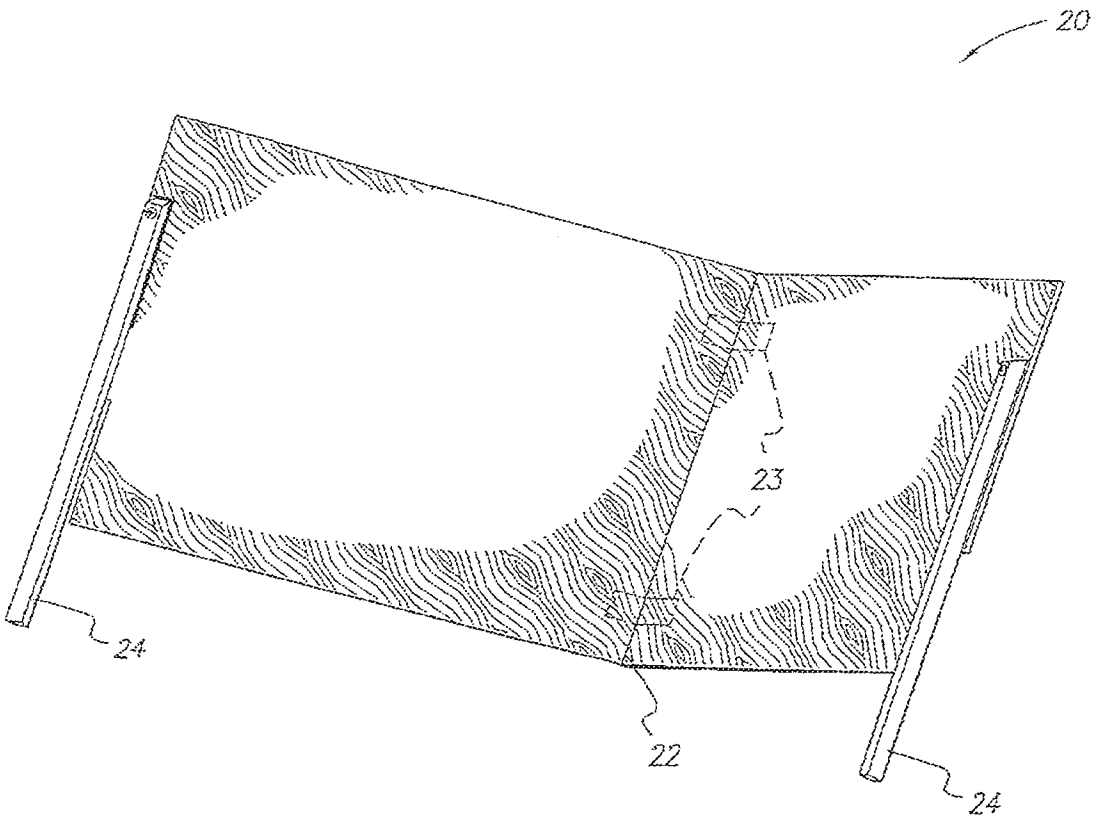
FIG. 3A is an exemplary view of the rear of the backrest for the bed to a sofa conversion frame according to an exemplary embodiment of the present disclosure.

Referring to the exemplary embodiments of FIG. 3A, the backrest 20 includes an elongate, substantially rectangular, panel having a relatively larger dimension than the footer 30 so as to provide enough area to support the user's back. Each opposite end of the backrest 20 can include connectors, for example, mounting hardware for assembly 24, for connecting the backrest 20 to the respective armrests 40, 50. In an exemplary embodiment, the mounting hardware 24 may be foldable to the side in order to, for example, allow the portion of the mounting hardware extending beyond the body of the backrest 20 to be placed against the bottom of the backrest 20 or up to the side of the backrest 20 to allow for easier storage. In an exemplary embodiment, the mounting hardware 24 includes an elongate mounting post attached to the back of the backrest 20 with fasteners. In cases where the frame is one piece, connectors may not be required.

Figure 3B:
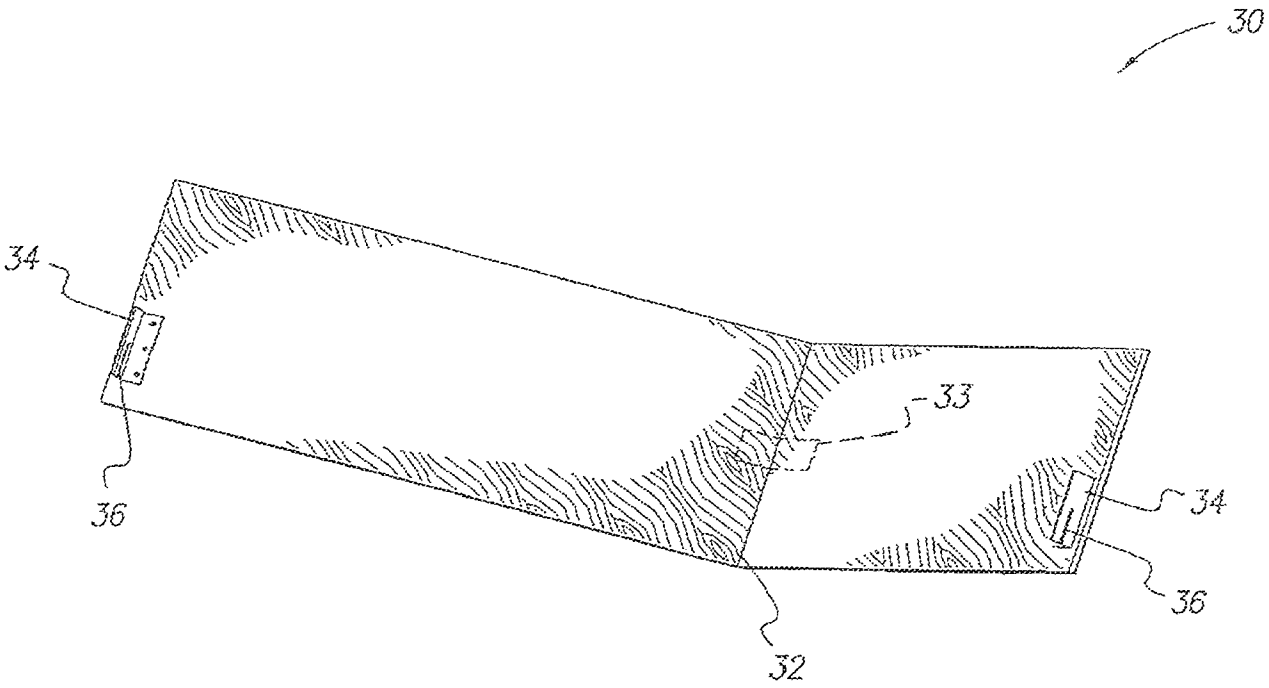
FIG. 3B is an exemplary view of the rear of the footer for the bed to a sofa conversion frame according to an exemplary embodiment of the present disclosure.

Referring to the exemplary embodiments of FIG. 3B, the footer 30 includes an elongate, substantially rectangular, panel, which may be foldable, having a relatively narrower dimension than the backrest 20, since the footer 30 serves, for example, to cover the bottom of the bed B, to connect the armrests 40, 50 together, and as a place for the user's feet to abut. Each opposite end of the footer 30 may include connectors, for example, mounting hardware or assembly 34, for connecting footer 30 to the respective armrests 40, 50. In an exemplary embodiment, the mounting hardware 34 includes a mounting bracket attached to the back of the footer 30 with fasteners. Each mounting bracket may include a mounting slot 36 configured to mate with a corresponding bracket in the respective armrests 40, 50.

Figure 3C:
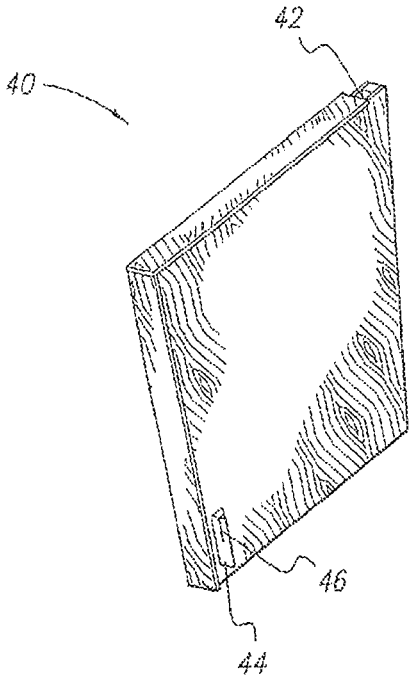
FIG. 3C is an exemplary view of the left armrest for the bed to a sofa conversion frame according to an exemplary embodiment of the present disclosure.
Figure 3D:
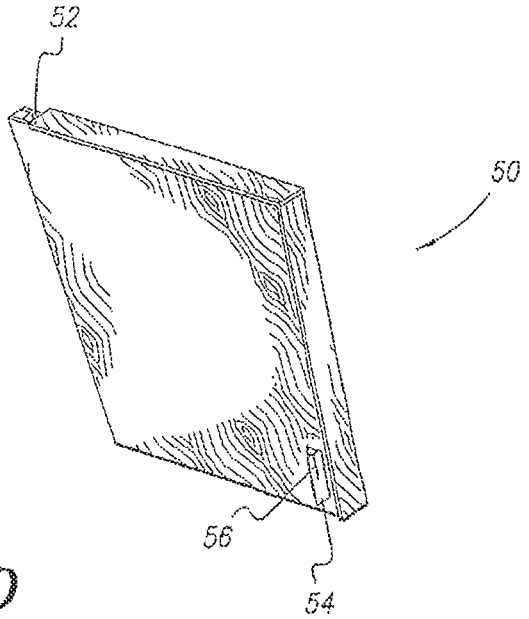
FIG. 3D is an exemplary view of the right armrest for the bed to a sofa conversion frame according to an exemplary embodiment of the present disclosure.

Referring to the exemplary embodiments of FIGS. 3C and 3D, examples of the left armrest 40 and the right armrest 50 form a base or foundation for the sofa conversion frame 10 allowing the backrest 20 and the footer 30 to be mounted and or connected thereon. In an exemplary embodiment, the frame 10 can be manufactured to be one piece (a unit), with 20, 30, 40, and 50 mounted and or connected. With particular reference to the exemplary embodiment of FIG. 3C, and example of the left armrest 40 may be a trapezoidal block having a width for comfortably supporting a user's arm. In an embodiment, the rear face of the armrests may be angled (angled meaning at an angle of other than 90° or 180° with respect to the ground). In an example of the embodiment, the armrests may have structure or connectors configured to allow the backrest to be connected at an angle, wherein the connection angle can be the same or different from the angle of the rear face of the armrests. In an embodiment, the backrest may be angled or curved such that a part of the backrest engaging the armrests may be at a different angle from the top of part of the backrest acting as a back support. In an embodiment, the armrest 40, for example, at or near an angled portion of the armrest 40, may include a connector, for example, a mounting bore, hole or recess 42, configured to receive a connector of the backrest 20, for example, one of the mounting posts 24 on the backrest 20. In an embodiment, the front, bottom inside portion of the left armrest 40 may include a connector, for example, mounting hardware or bracket 44 with a mounting slot 46, configured to connect with a connector on the footer 30, for example, with the corresponding mounting bracket 34 and slot 36 on the footer 30. In an embodiment, a connector on the armrest for connecting the armrest to the footer may be placed on any portion of the armrest, for example, on the bottom face, front face or outside face. Since the right armrest 50 may be similarly configured, corresponding similar parts have been referenced with similar numbers (recess 52, bracket 54, and mounting slot 56). The left and right armrests may be mirror-images of each other, or may be formed differently, for example, in shape, design, or type or arrangement of connectors.

In an embodiment, an armrest 40, 50 may connect to the backrest 20 and/or the footer 30 from the inside, outside, the end or a combination of points of each. Further, the armrest 40, 50 may connect to the backrest 20 and/or the footer 30 through connectors made of metal (e.g., hooks, nuts and bolts, screws, joints, mechanical locking systems), wood (e.g., dowels, joints, mechanical locking systems), composite materials, or any combination thereof. Connectors may be permanent or may be detachable pieces.

In an embodiment, the armrests may act as supports for connecting a backrest, but may not act as armrests, for example, not rising above the height of the upper surface of the bed comprising i) a conventional manufactured mattress, or ii) a conventional manufactured mattress and a box spring, or iii) a conventional manufactured mattress and a two rail frame, optionally with a box spring, for example the upper surface of the mattress regardless of configuration. In an embodiment, the height of the armrests may be adjustable in relation to the upper surface of the mattress. In an embodiment, the length of the backrest and/or footer may be adjustable to allow the frame to be configured to various size beds, for example various size mattresses. In an embodiment, the connectors or structure of the armrests and/or backrests may be adjustable to allow, for example, the backrest to recline to various positions. In an embodiment, the connectors or structure of the armrest and/or footer may be adjustable to allow, for example, the footer to move and/or angle up so that the footer acts as a footrest for a seated user.

In an embodiment, the sofa conversion frame 10 converts an existing bed B comprising i) a conventional manufactured mattress, or ii) a conventional manufactured mattress and a box spring, or iii) a conventional manufactured mattress and a two rail frame, optionally with a box spring, into a sofa. In an embodiment, the frame allows for a tool-less configuration for connecting the parts together results in a relatively easy assembly and disassembly while the foldable backrest 20 and footer 30 allows for easy storage with minimal space.

It is to be understood that the sofa conversion frame 10 encompasses a variety of alternatives. For example, the sofa conversion frame 10 may be made from, for example, wood, plastic, steel and/or composites, and covered or not by fabrics. For example, other types of tool-less or substantially tool-less connecting configurations are alternatives, such as, for example, tongue and groove configurations, locking pins, wing nuts, or presenting the frame as a solid state unit, etc.

Additionally, it is understood that the sofa conversion frame 10 may be used in combination with any suitable desired accessories or other articles of furniture. For example, backrest 20 may be used in combination with, or include, for example, as a unitary article, a set of drawers, a cabinet or the like, allowing the frame 10 to incorporate storage functionality. It should be understood that any desired storage space or other suitable article of furniture may be incorporated into frame 10 without departing from the spirit or scope of the disclosure.

In an embodiment, the frame is provided without a mattress support structure. In an embodiment, the footer contacts the front face of the mattress. In an embodiment, the frame and/or pieces thereof may have curved and/or cushioned surfaces.

In an embodiment, the frame may include, optionally as a unitary article, a storage feature, which includes, for example, set of drawers, shelves, a cabinet or the like, positioned in at least one armrest and/or the backrest, allowing the frame to incorporate storage functionality.

Figure 4A:
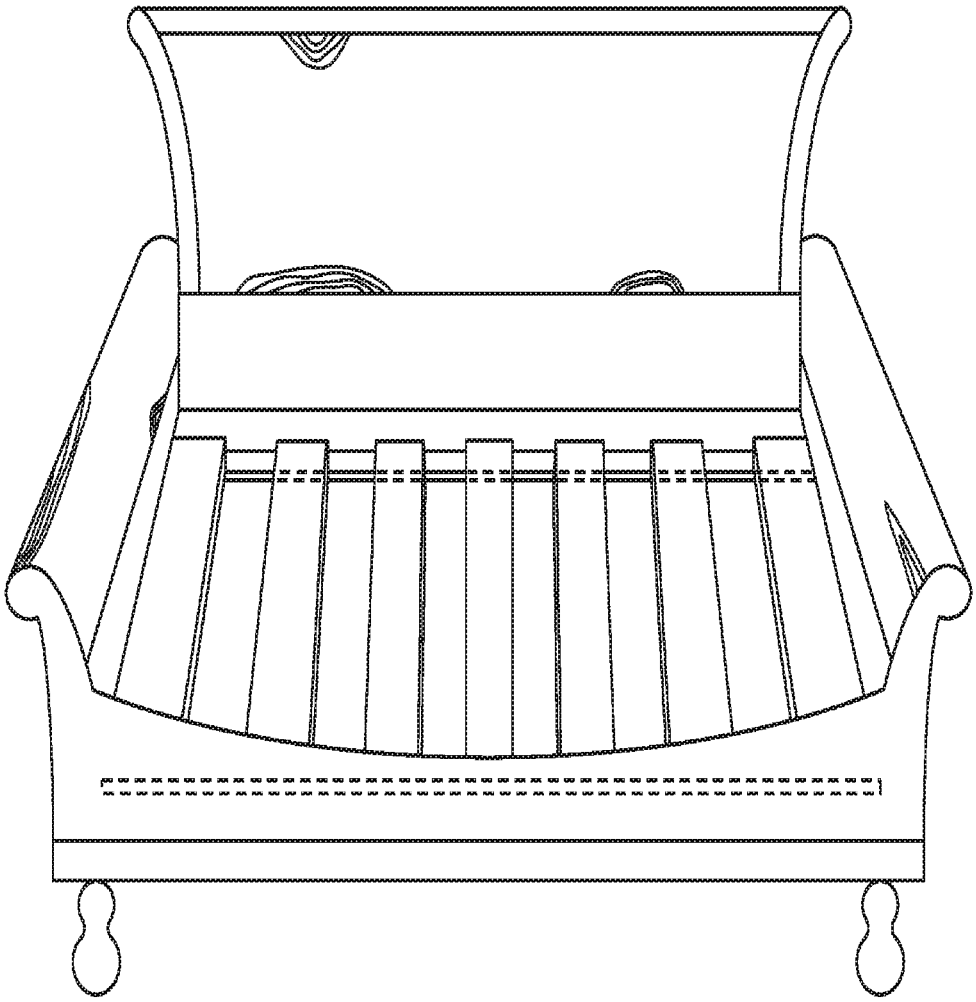
FIGS. 4A-B are exemplary views of embodiments for the bed to a sofa conversion frame according to an exemplary embodiment of the present disclosure.
Figure 4B:
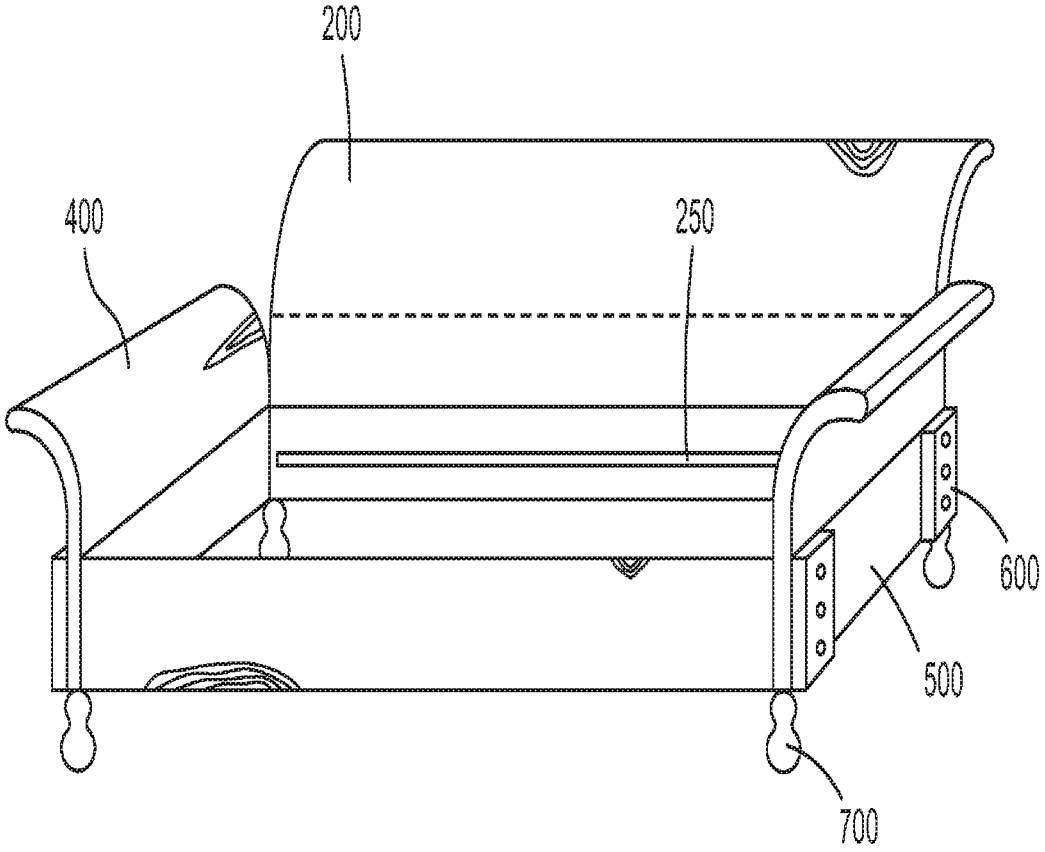

FIG. 4A shows an embodiment with slats arranged on ridges. FIG. 4B shows an embodiment for a frame 100 according to an exemplary embodiment of the present disclosure. The frame has a left side armrest 400, a right side armrest 500, a backrest 200, and a footer 300. There are connectors 600 for connecting the frame together, the connectors involving structure on the outside of the armrests. There may be legs 700 under the frame, which may be attached to the armrests 400, 500, and/or to the backrest 200 and footer 300. The backrest 200 has a backrest ridge 250 that may be removable. The footer 300 may have a footer ridge 350.

Figure 5A:
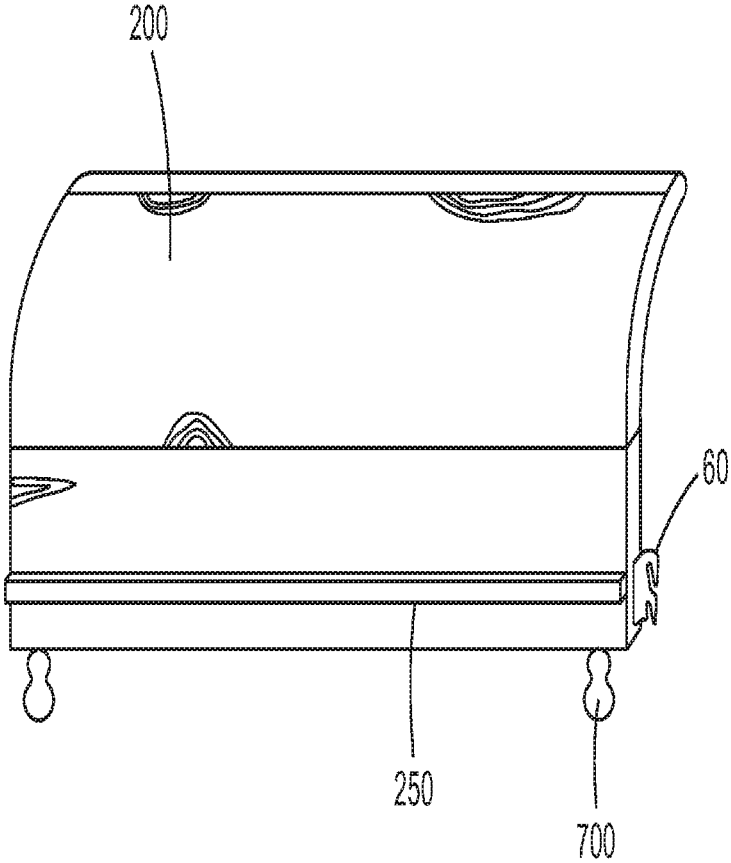
FIGS. 5A-B are exemplary views of a backrest for the bed to a sofa conversion frame according to an exemplary embodiment of the present disclosure.
Figure 5B:
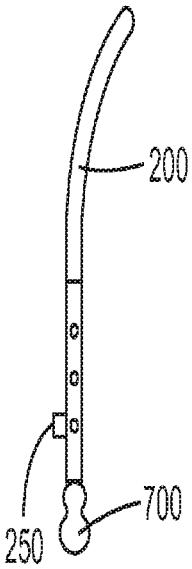

FIG. 5A shows an example of a backrest 200 and FIG. 5B shows an example of a side view of the backrest 200. The backrest 200 may be between about 56-84 inches long, for example, about 72¾ inches long. The bottom of the ridge 250 may be at the bottom of the backrest 200, or may be spaced about 0.5-24 inches from the bottom of the backrest 200, for example, about 0.5 inches from the bottom of the backrest 200. The legs 700 may be attached to the backrest 200 and may be about 1-12 inches tall, for example about 8.5 inches tall. The backrest ridge 250 may be about 0.05-2 inches tall, for example, about 1 inch tall. The examples shown in FIGS. 5A and 5B may have connectors made of metal (e.g., hooks, nuts and bolts, screws, joints, mechanical locking systems), wood (e.g., dowels, joints, mechanical locking systems), composite materials, or any combination thereof. Connectors may be permanent or may be detachable pieces and not visible from the outer side, as example when covered by upholstery.

Figure 6A:
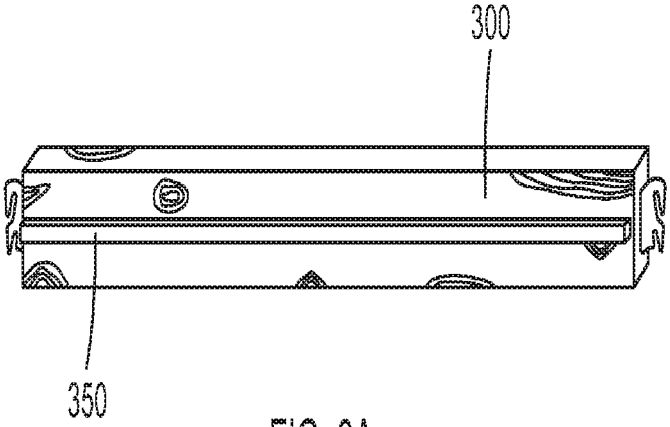
FIGS. 6A-B are exemplary views of a footer for the bed to a sofa conversion frame according to an exemplary embodiment of the present disclosure.
Figure 6B:
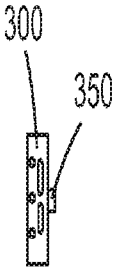

FIG. 6A shows an example of a footer 300 and FIG. 6B shows an example of a side view of the footer 300. The footer 300 may be between about 56-84 inches long, for example, about 72¾ inches long. The footer has a footer ridge 350 on an inner surface thereof that may be removable. Legs 700 (not shown) may be attached to the footer 300 and may be about 1-12 inches tall, for example about 8.5 inches tall. The footer ridge 350 may be about 0.05-2 inches tall, for example, about 1 inch tall. The examples shown in FIGS. 6A and 6B may have connectors made of metal (e.g., hooks, nuts and bolts, screws, joints, mechanical locking systems), wood (e.g., dowels, joints, mechanical locking systems), composite materials, or any combination thereof. Connectors may be permanent or may be detachable pieces and not visible from the outer side, as example when covered by upholstery.

Figure 7A:
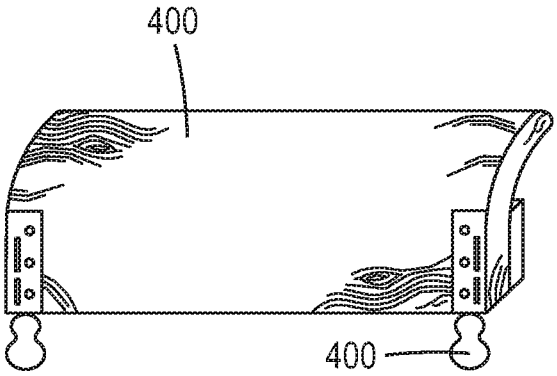
FIGS. 7A-C are exemplary views of an armrest for the bed to a sofa conversion frame according to an exemplary embodiment of the present disclosure.
Figure 7B:
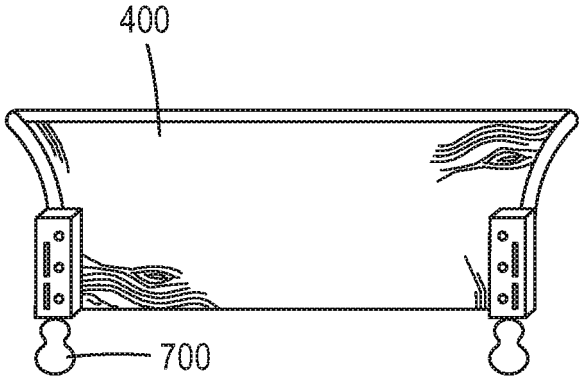
Figure 7C:
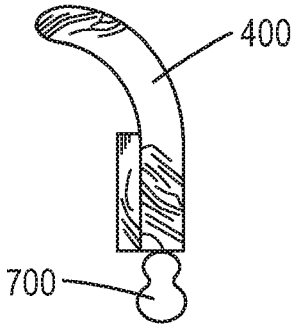

FIG. 7A shows an inner side of armrest 400, where the connectors are flush to the side. FIG. 7B shows an outer side of armrest 400, where the connectors are not flush to the side, but in an embedment, could be flush with the side or not visible from the outer side, as example when covered by upholstery. FIG. 7C shows a side view of the armrest 400. The armrest 400 may be between about 28-76 inches long, for example, about 38 inches long. The armrest 400 may have an armrest ridge (not shown) on an inner surface thereof that may be removable. Legs 700 may be attached (or not attached) to the armrest 400 and may be about 1-12 inches tall, for example about 8.5 inches tall. The armrest ridge may be about 0.05-2 inches tall, for example, about 1 inch tall.

Figure 8:
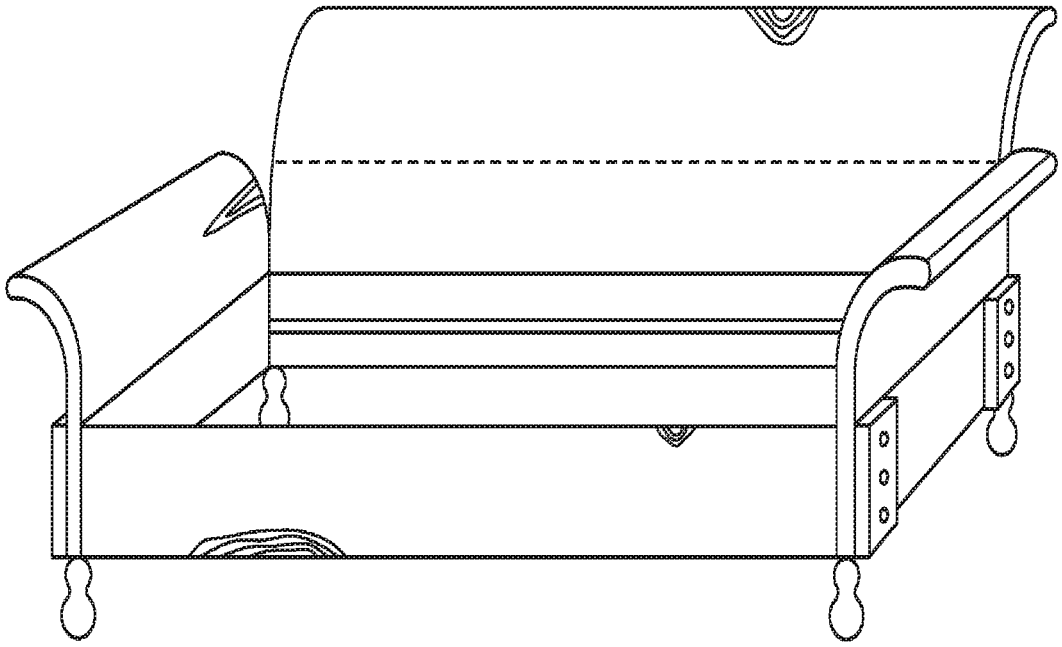
FIG. 8 is a view of an embodiment for the bed to a sofa conversion frame according to an exemplary embodiment of the present disclosure.

FIG. 8 is an exemplary view of an embodiment for the bed to a sofa conversion frame 800 according to an exemplary embodiment of the present disclosure.

FIGS. 9A-9D show views of an exemplary embodiment for the bed to a sofa conversion frame 900 according to an exemplary embodiment of the present disclosure.

In an embodiment, the backrest 904 may move from a sofa position to a bed position, in order to convert the frame from a sofa configuration to a bed configuration.

In an embodiment, an optional cushion 901 is provided. The cushion may be placed on a mattress 909 that is contained within the frame 900. A single cushion, two cushions, three cushions or more could be provided along the length of the mattress 909.

The backrest 904 may be positioned above the cushion 901 (or above the mattress 909, if no cushion is provided) to have the frame 900 in a sofa configuration. Also, the backrest 904 may be positioned adjacent the cushion 901 and above the mattress 909. This allows the mattress 909 to extend beyond the front surface (facing the seating area) of the backrest 904, and optionally beyond the entire backrest 904, such that only a portion of the mattress's upper surface forms a seating area for the sofa configuration. This may allow a user to sit in a position such that the person's knees extend approximately to the end of the seating area and allow the lower legs to dangle or extend to the floor.

The backrest 904 may be positioned behind the cushion 901 (or behind the mattress 909, if no cushion is provided) to have the frame 900 in a bed configuration. This allows the entire upper surface of the mattress 909 to form a sleeping area for the bed configuration.

In an embodiment, the backrest 904 may move from a sofa position to a bed position by rotation. The backrest 904 may be attached to a position on the armrests 912, 913 of the frame 900 and pivot from the sofa position to the bed position. The backrest 904 may be attached to a rail or other attachment means (not shown) on the armrests 912, 913 of the frame 900 and slide from the sofa position to the bed position. Intermediate positions for the backrest 904 may be included, the intermediate positions being between the sofa position and the bed position, the intermediate positions being locked positions.

In an embodiment, the backrest 904 may have two posts 907 that attach to a position on the armrests 912, 913 of the frame 900. The posts 907 could also attach to a footer 905, or a bottom 914 of the frame 900, or a support 910 adapted to hold the mattress 909, or to a remainder of the backrest, the remainder adapted to not move.

In an embodiment, the posts 907 may move through slots 906 in the cushion 901. The slots 906 may also extend into the arm rests 912, 913.

In an embodiment, the backrest 904 may move to a bed position and allow a surface 904*a* to form a part of the surface for the bed. The surface 904*a* may be at the same or substantially the same level as the upper surface of the cushion 901 (or the upper surface of the mattress 909) to allow an additional surface area for the bed configuration. The backrest 904 may include a support leg (not shown) that supports the backrest 904 against the floor when the backrest 904 is in the bed position.

Figure 9A:
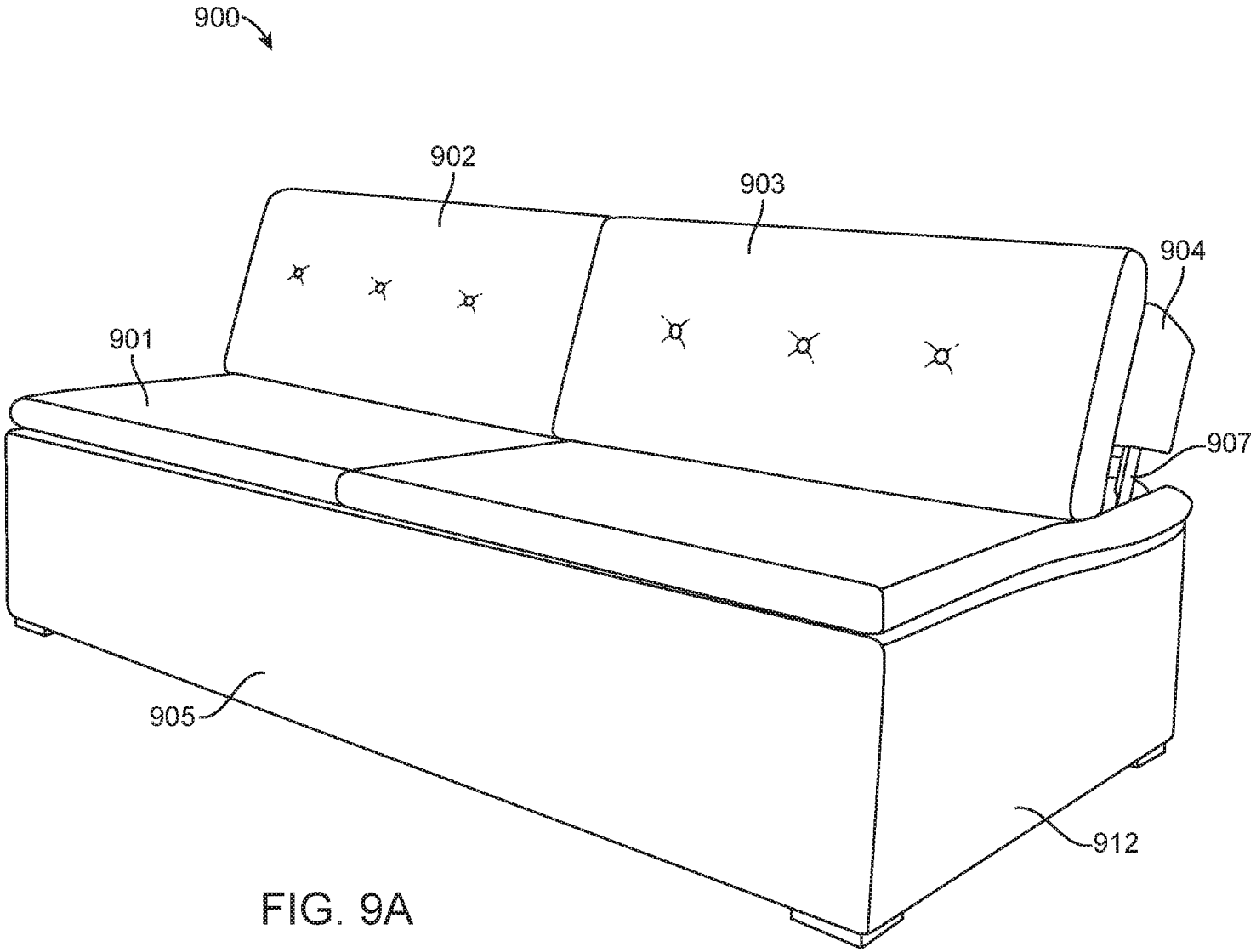
FIGS. 9A-9D show views of an exemplary embodiment for the bed to a sofa conversion frame according to an exemplary embodiment of the present disclosure.
Figure 9B:
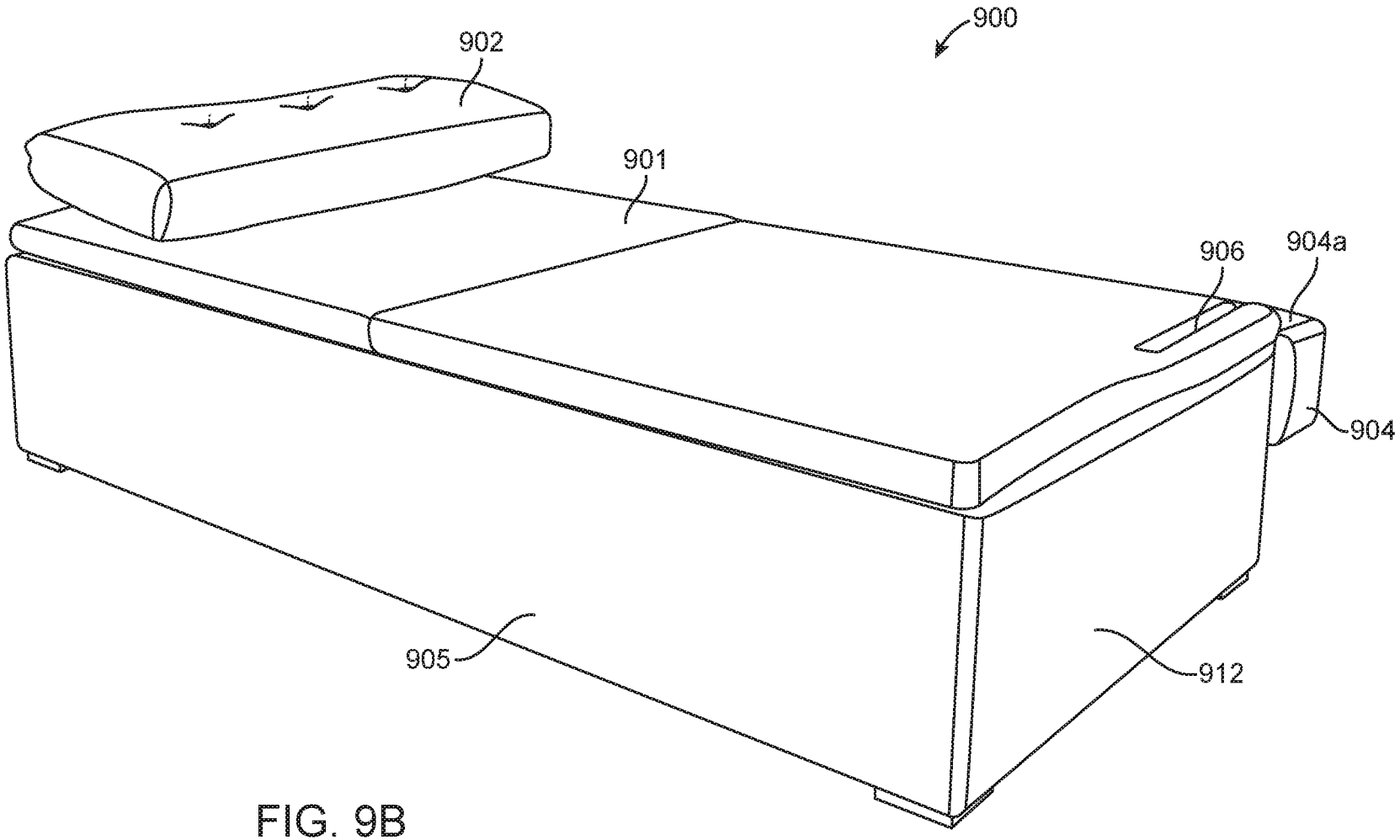
Figure 9C:
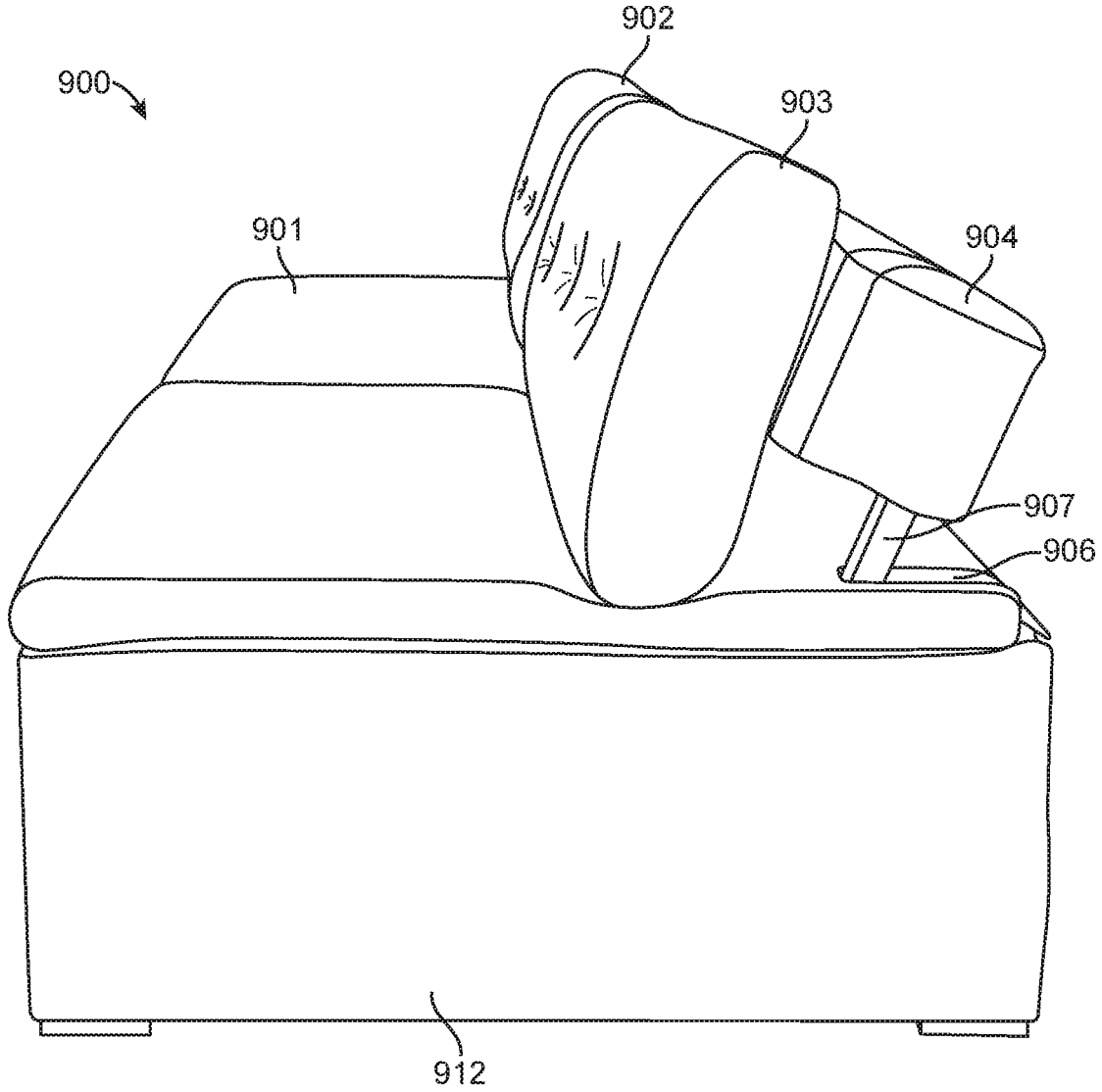
Figure 9D:
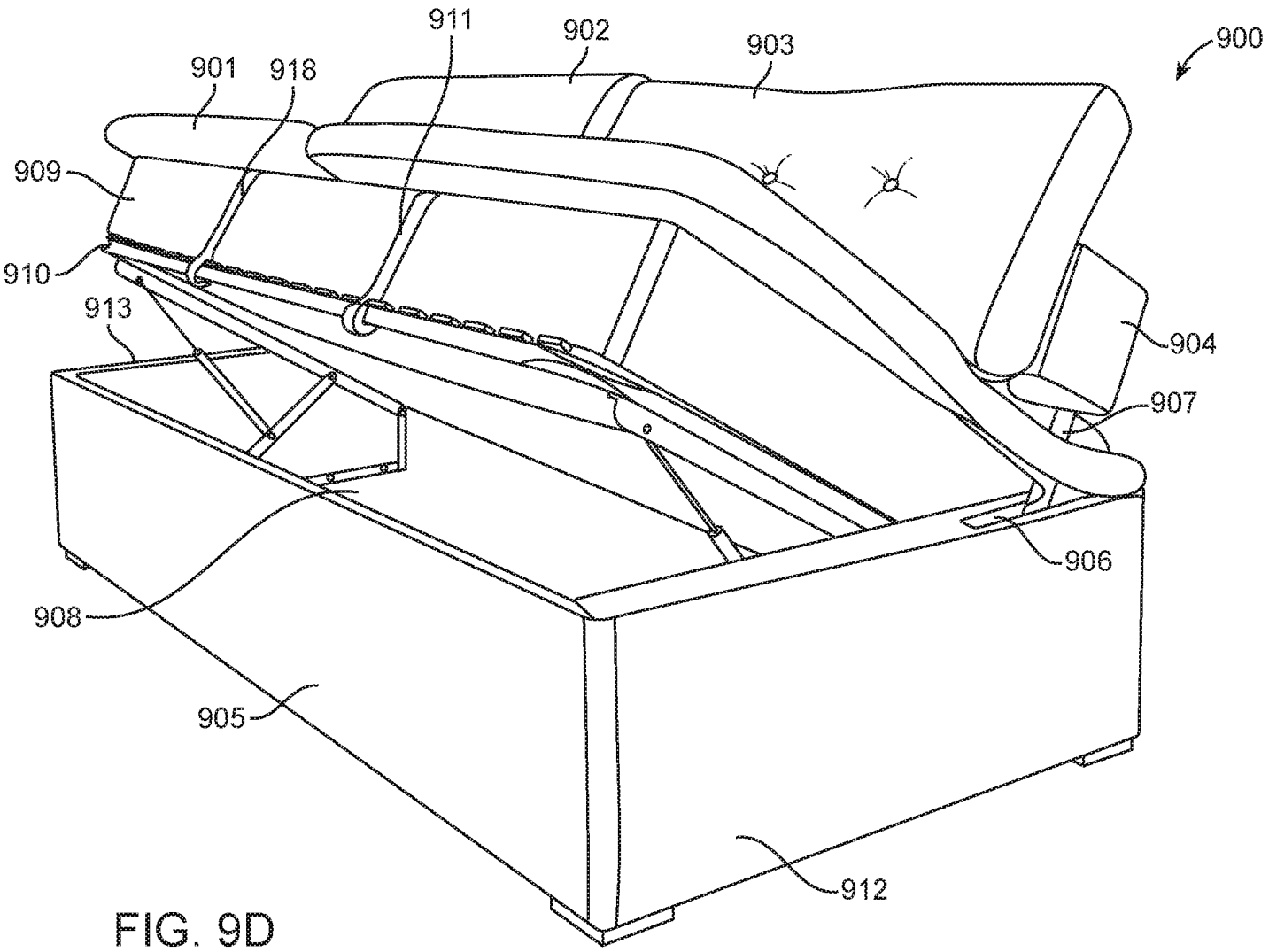

The frame 900 may optionally have the ability to open up as shown in FIG. 9*d*. The support 910 may pivot open to allow access to a storage space 908. The support 910 could attach to a footer 905, or a bottom of the frame 900, or to a remainder of the backrest, the remainder adapted to not move, or a combination thereof. The mattress 909 may be secured to the support 910 by attachment means, such as straps 911, 918.

In an embodiment, optional backrest cushions 902, 903 may be provided. The backrest cushions 902, 903 may be separate from the backrest 904 or may be removably attached to the backrest 904 (e.g., with attachment means, such as hook and loop fasteners, adhesive, snaps, tethers or other mechanical connectors), or may be permanently attached to the backrest 904 (e.g., such as by being sown together or by containing a piece of material that is integral from the backrest 904 to the backrest cushions 902, 903). A single backrest cushion, two backrest cushions, three backrest cushions or more could be provided along the length of the backrest 904. In an embodiment, a backrest cushion 902 may be moved from the backrest 904 and placed as a pillow or support when the frame is converted to a bed position.

FIGS. 10A-10F show views of an exemplary embodiment for the bed to a sofa conversion frame 1000 according to an exemplary embodiment of the present disclosure.

In an embodiment, the backrest 1010 may move from a sofa position to a bed position, in order to convert the frame from a sofa configuration to a bed configuration.

In an embodiment, an optional cushion 1001 is provided. The cushion may be placed on a mattress 1005 that is contained within the frame 1000. A single cushion, two cushions, three cushions or more could be provided along the length of the mattress 1005.

The backrest 1010 may be positioned above the cushion 1001 (and/or above the mattress 1005) to have the frame 1000 in a sofa configuration. Also the backrest 1010 may be positioned adjacent the cushion 1001 and above the mattress 1005. These arrangements allow the mattress 1005 to extend beyond the front surface (facing the seating area) of the backrest 1010, and optionally beyond the entire backrest 1010, such that only a portion of the mattress's upper surface forms a seating area for the sofa configuration. This may allow a user to sit in a position such that the person's knees extend approximately to the end of the seating area and allow the lower legs to dangle or extend to the floor.

The backrest 1010 may be positioned behind the cushion 1001 (and/or behind the mattress 1005) to have the frame 1000 in a bed configuration. This allows the entire upper surface of the mattress 1005 to form a sleeping area for the bed configuration.

In an embodiment, the backrest 1010 may move from a sofa position to a bed position by rotation. The backrest 1010 may be attached to a position on the armrests 1003, 1004 of the frame 1000 and pivot from the sofa position to the bed position. The backrest 1010 may be attached to a rail or other attachment means (not shown) on the armrests 1003, 1004 of the frame 1000 and slide from the sofa position to the bed position. Intermediate positions for the backrest 1010 may be included, the intermediate positions being between the sofa position and the bed position, the intermediate positions being locked positions.

In an embodiment, the backrest 1010 may pivot have two posts (not shown) that attach to a position on the armrests 1003, 1004 of the frame 1000. The posts could also attach to a footer 1002, or a bottom (not shown) of the frame 1000, or a support 1008 adapted to hold the mattress 1005, or to a remainder of the backrest, the remainder adapted to not move.

In an embodiment, the movable backrest 1010 may pivot by means of a hinge connected to a remainder of the backrest, the remainder adapted to not move.

In an embodiment, the posts may move through slots (not shown) in the cushion 1001.

In an embodiment, the backrest 1010 may move to a bed position and allow a surface 1010*a* to form a part of the surface for the bed. The surface 1010*a* may be at the same or substantially the same level as the upper surface of the cushion 1001 (or the upper surface of the mattress 1005) to allow an additional surface area for the bed configuration. The backrest 1010 may include a support leg 1011 that supports the backrest 1010 against the floor when the backrest 1010 is in the bed position. One, two, three or more support legs could be provided. The support legs could be foldably attached to the backrest 1010 and fold down when the backrest 1010 is in the bed position.

In an embodiment, when the backrest 1010 is in a bed position, the cushion 1001 may be moved onto the surface 1010*a* to form a cushioned surface on the backrest 1010. The cushion 1001 may be pivotally attached to armrests 1002, 1003 or the backrest 1010 or a remainder of the backrest, the remainder adapted to not move. The surface 1001*a* may be at the same or substantially the same level as the upper surface of the mattress 1005 to allow an additional surface area for the bed configuration.

Figure 10A:
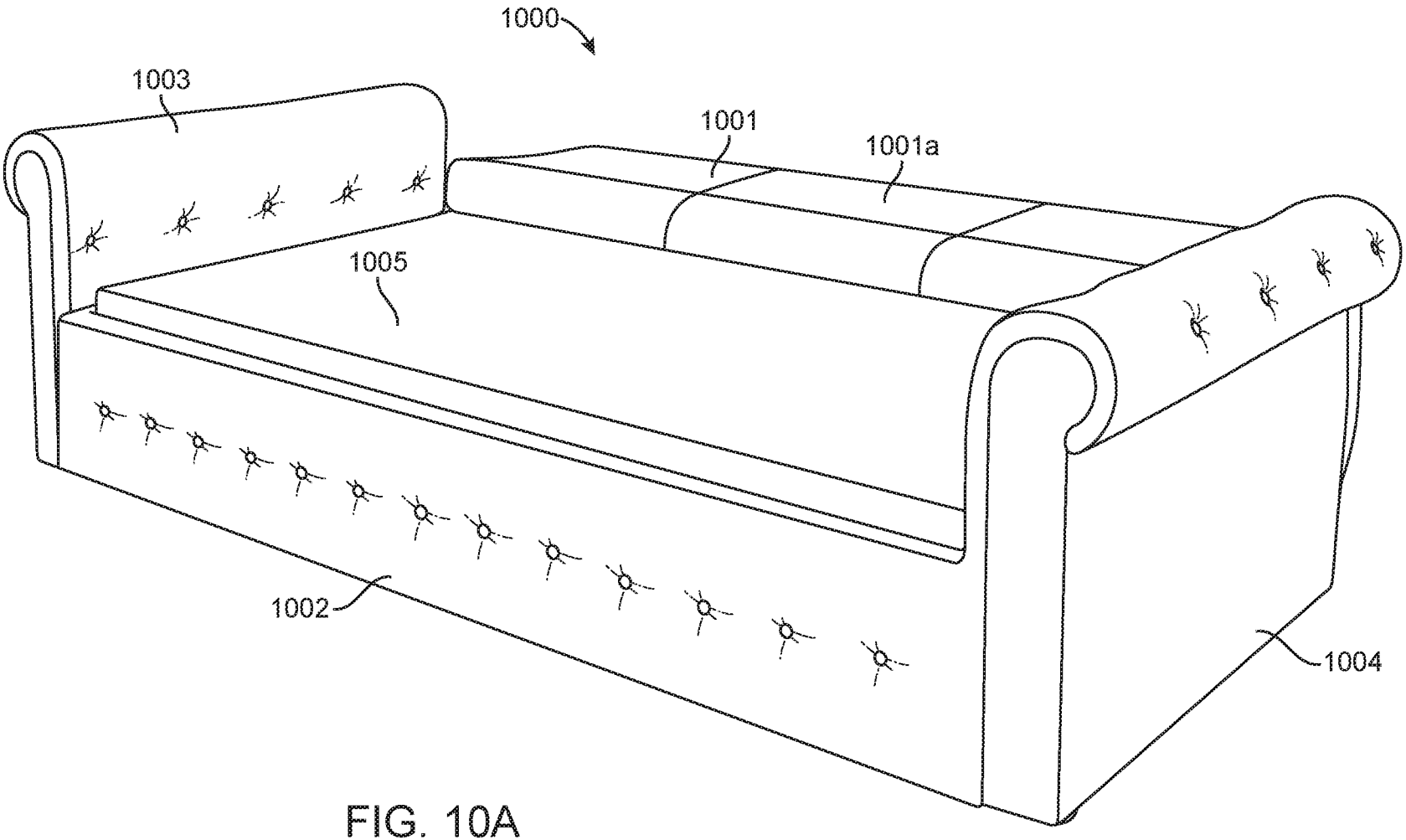
FIGS. 10A-10F show views of an exemplary embodiment for the bed to a sofa conversion frame according to an exemplary embodiment of the present disclosure.
Figure 10B:
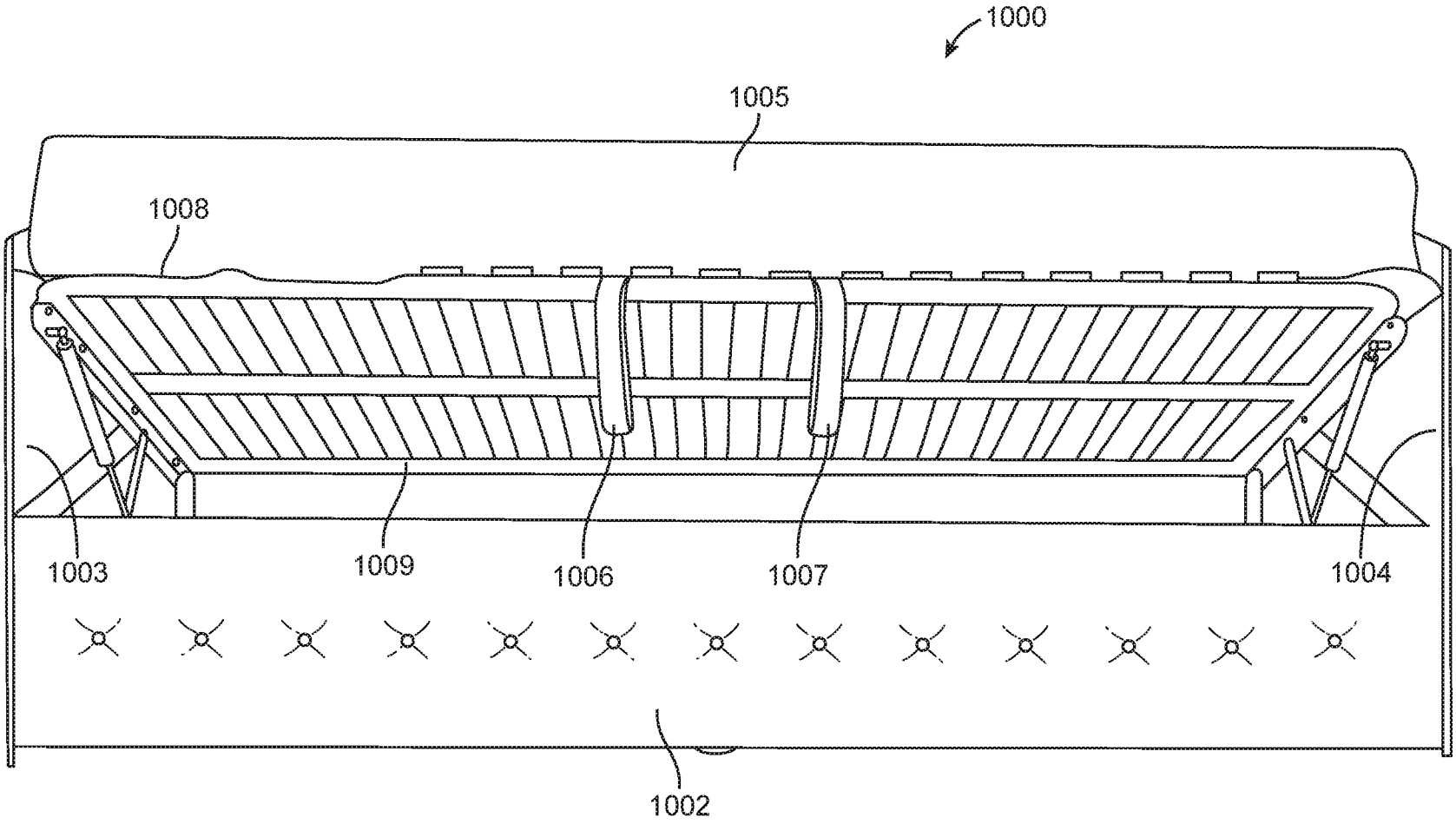
Figure 10C:
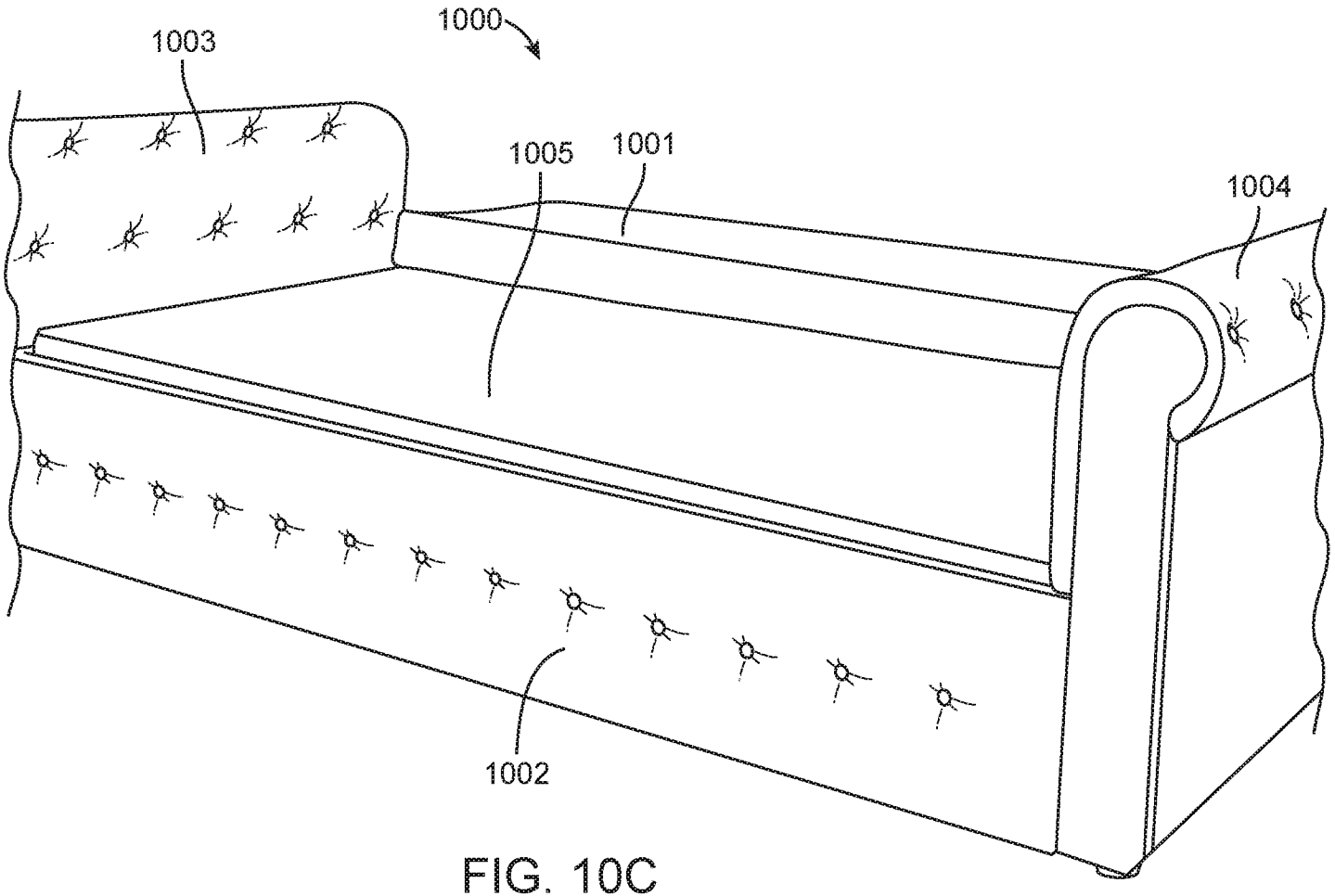
Figure 10D:
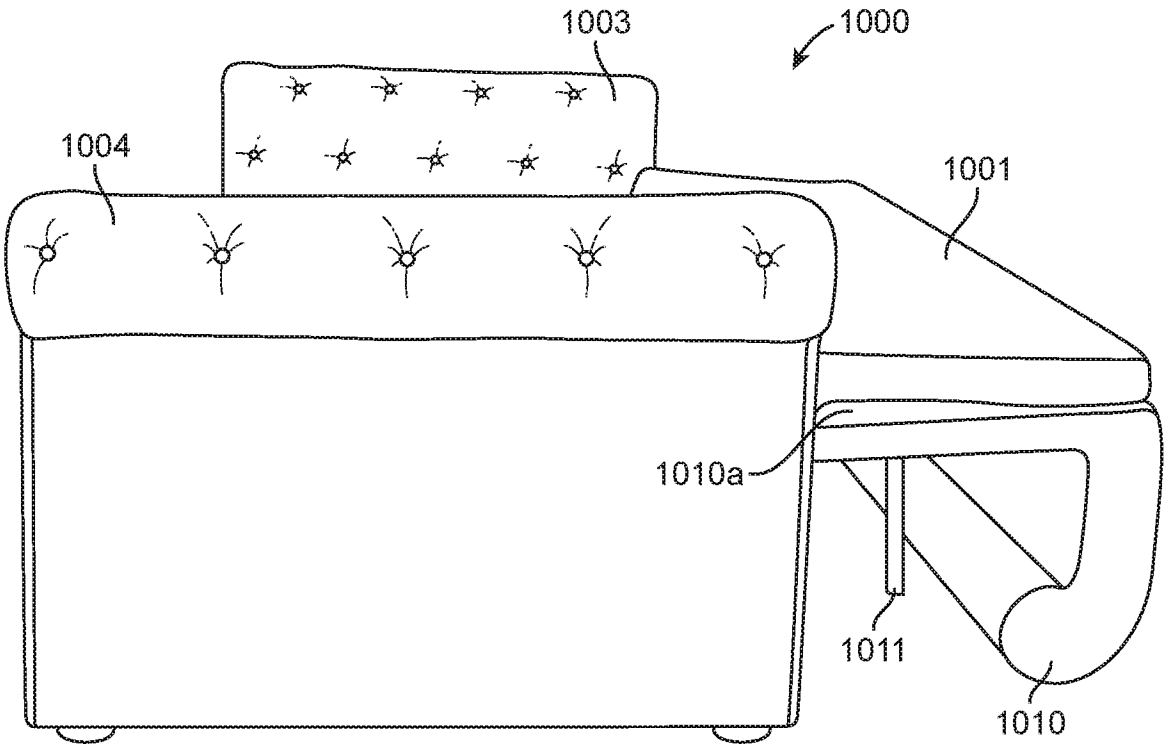
Figure 10E:
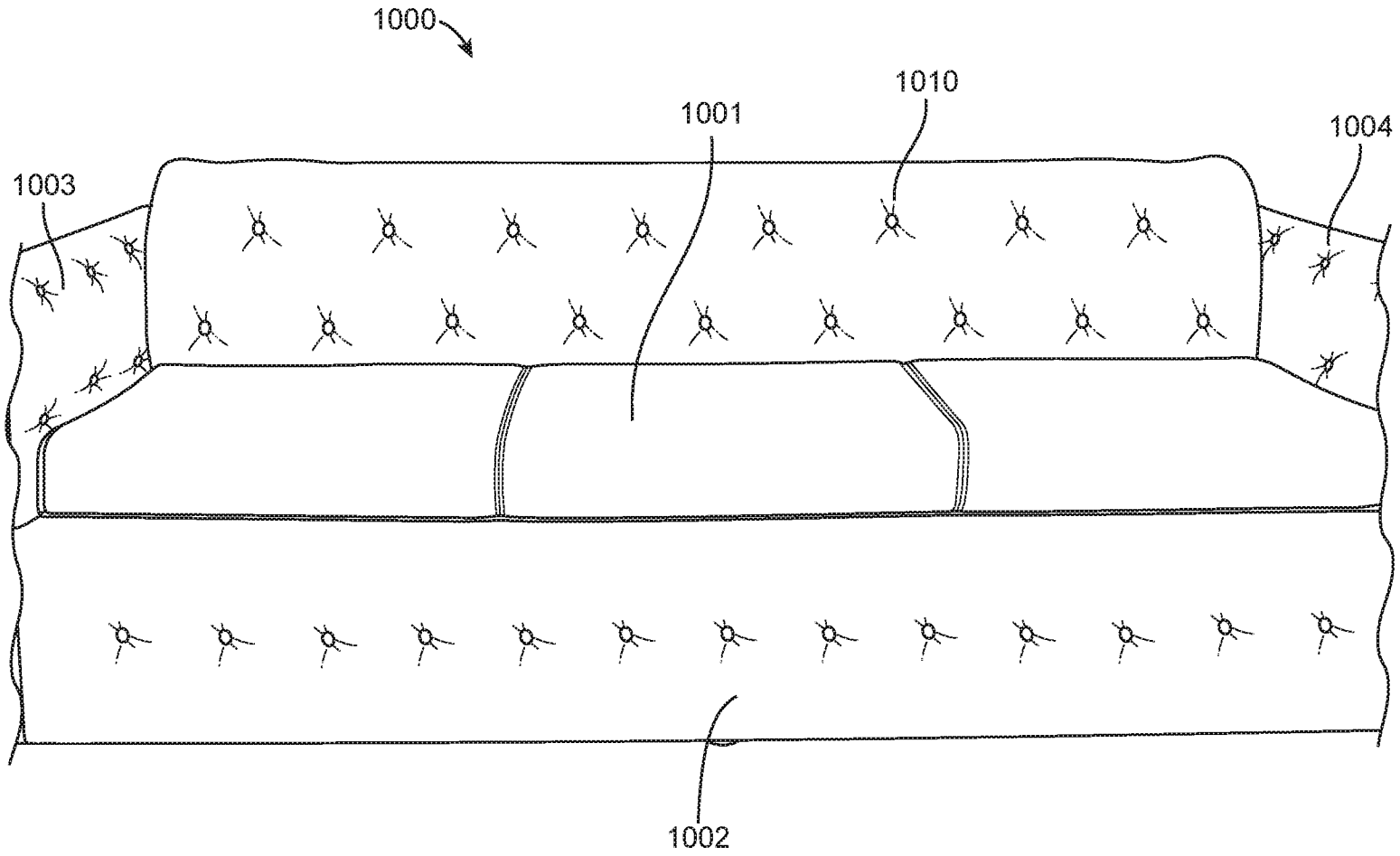
Figure 10F:
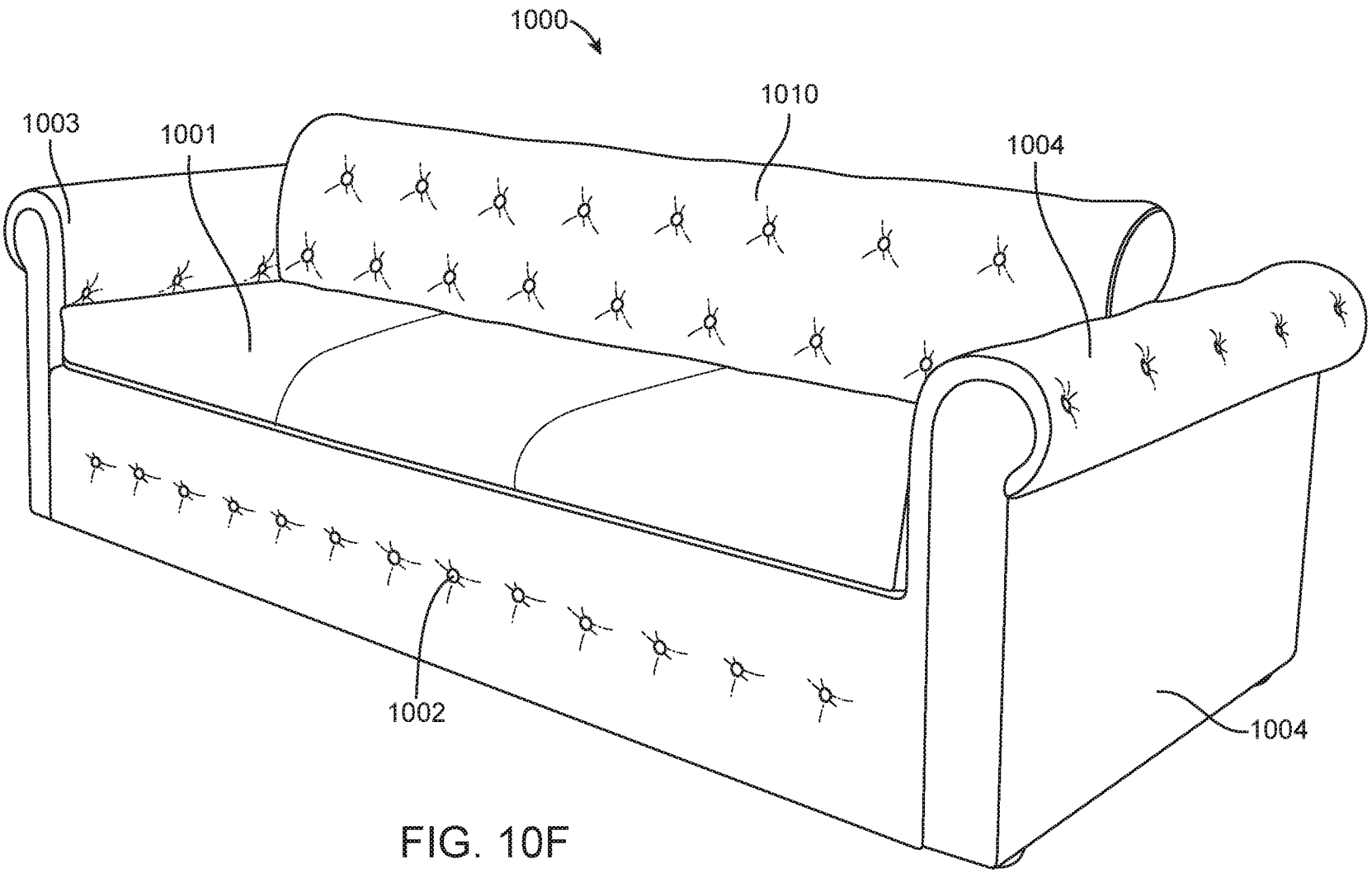

The frame 1000 may optionally have the ability to open up as shown in FIG. 10B. The support 1008 may pivot open to allow access to a storage space 1009. The support 1008 could attach to a footer 1002, or a bottom (not shown) of the frame 1000, or to a remainder of the backrest, the remainder adapted to not move, or a combination thereof. The support 1008 could have pull tabs 1006, 1007 (in any amount, from one, two, three, or more) to assist with opening the support 1008.

In an embodiment, the backrest cushion 1001 may be separate from the backrest 1010 or may be removably attached to the backrest 1010 (e.g., with attachment means, such as hook and loop fasteners, adhesive, snaps, tethers or other mechanical connectors), or may be permanently attached to the backrest 1010 (e.g., such as by being sown together or by containing a piece of material that is integral from the backrest 1010 to the backrest cushion 1001, or by being pivotally attached to the backrest 1010). A single backrest cushion, two backrest cushions, three backrest cushions or more could be provided along the length of the backrest 1010. In an embodiment, a backrest cushion 1001 may be moved from the backrest 1010 and placed as a pillow or support when the frame is converted to a bed position.

Throughout this disclosure embodiments of a frame have been discussed. The disclosure further contemplates that all embodiments that directed to convert a traditional bed comprising i) a conventional manufactured mattress, or ii) a conventional manufactured mattress and a box spring, or iii) a conventional manufactured mattress and a two rail frame, optionally with a box spring, into a sofa, means it is applicable to convert a bed that may comprise just a mattress, or just a mattress and box spring, just a mattress and bed frame, or just a mattress, box spring and bed frame. Further, the embodiments are also applicable to a bed that also has decorative features, such as a decorative frame.

It is to be understood that the present invention is not limited to the embodiments described above, but encompasses any and all embodiments within the scope of the following claims.

The invention claimed is:

1. A stand-alone furniture frame, where the furniture frame is configured to convert a bed into a sofa, the bed comprising a conventional manufactured mattress and a two rail frame with a box spring, where the conventional manufactured mattress is a mattress manufactured for traditional beds and is not configured to be folded when converted into the sofa, the furniture frame comprising:

a backrest;

a footer;

a pair of armrests forming a base; and a space defined by the backrest, footer, and armrests, the space configured to he filled by the bed, wherein the backrest, footer and armrests, as a unitary piece or when connected together to form an assembled frame, form a frame configured for surrounding the bed to convert the bed into the sofa such that at least a portion of an upper surface of the bed forms a seating area of the sofa, and wherein the backrest is movable from a sofa position to a bed position, in order to convert the frame from a sofa configuration to a bed configuration, wherein the backrest comprises a frame and a cushion, wherein the backrest frame, in the sofa configuration, is arranged over the bed, such that the seating area of the sofa is less than the upper surface of the bed, and wherein the backrest, in the bed position, has a surface that forms a surface extension of the upper surface of the bed, wherein the furniture frame has two short sides, and two long sides, wherein the backrest is the only component on the short and long sides of the frame which is movable and forms a surface extension of the upper surface of the bed, and wherein the backrest is located on a long side of the furniture frame.

2. The stand-alone furniture frame of claim 1, wherein the backrest is moveable from the sofa position to the bed position by rotation.

3. The stand-alone furniture frame of claim 1, wherein the backrest is moveable from the sofa position to the bed position by sliding.

4. The stand-alone furniture frame of claim 1, wherein the surface extension is at the same or substantially the same level as the upper surface of a cushion on the upper surface of the bed.

5. The stand-alone furniture frame of claim 1, wherein the surface extension is at the same or substantially the same level as the upper surface of a mattress on the upper surface of the bed.

6. The stand-alone furniture frame of claim 1, wherein, in the bed configuration, a top surface of the cushion is at the same or substantially the same level as the upper surface of the bed.

7. The stand-alone furniture frame of claim 1, wherein the frame is configured to allow a mattress to be used as both a bed and a sofa without folding the mattress.

8. The stand-alone furniture frame of claim 1, wherein the frame is configured to allow the backrest to be connected at an angle.

9. The stand-alone furniture frame of claim 1, wherein the backrest, in the sofa configuration, is angled such that a part of the backrest engaging the armrests is at a different angle from a top part of the backrest acting as a back support.

10. The stand-alone furniture frame of claim 1, wherein the armrests rise to a height above the upper surface of the bed.

11. A stand-alone furniture frame, where the furniture frame is configured to convert a bed into sofa, the bed comprising a conventional manufactured mattress and a two rail frame with a box spring, where the conventional manufactured mattress is a mattress manufactured for traditional beds and snot configured to be folded when converted into the sofa, the furniture frame comprising:

a backrest;

a footer;

a pair of armrests forming a base; and a space defined by the backrest, footer, and armrests, the space configured to be filled by the bed, wherein the backrest, footer and armrests, as a unitary piece or when connected together to form an assembled frame, form a frame configured for surrounding the bed to convert the bed into the sofa such that at least a portion of an upper surface of the bed forms a seating area of the sofa, and wherein the backrest is movable from a sofa position to a bed position, in order to convert the frame from a sofa configuration to a bed configuration, wherein the seating area of the sofa is less than the upper surface area of the bed, wherein the furniture frame has two short sides, and two long sides, wherein the backrest is the only component on the short and long sides of the frame which is movable and forms a surface extension of the upper surface of the bed, and wherein the backrest is located on a long side of the furniture frame.

* * * * *